United States Patent [19]

DeSmet et al.

[11] Patent Number: 4,585,676

[45] Date of Patent: Apr. 29, 1986

[54] DECORATIVE PULL-STRING BOWS

[76] Inventors: Vicki M. DeSmet; Gregory L. DeSmet, both of 1909 E. Huntington Dr., Duarte, Calif. 91010

[21] Appl. No.: 568,709

[22] Filed: Jan. 6, 1984

[51] Int. Cl.[4] ..... A41G 1/00; D04D 7/10

[52] U.S. Cl. ..... 428/5; 156/70; 223/46; 428/26; 428/906

[58] Field of Search ..... 428/26, 4, 5, 906, 192; 156/70; 223/46

[56] References Cited

U.S. PATENT DOCUMENTS

| | | | |
|---|---|---|---|
| 2,849,821 | 9/1958 | Doig | 428/5 |
| 3,256,129 | 6/1966 | Wallerstein | 428/5 |
| 3,370,779 | 2/1968 | Cole | 428/4 X |
| 3,632,464 | 1/1972 | Grikis | 428/4 |
| 3,637,455 | 1/1972 | Pearson et al. | 428/4 |
| 3,790,041 | 2/1974 | Pearson et al. | 156/70 X |
| 3,922,407 | 11/1975 | Nimmo, Jr. et al. | 428/5 |
| 3,954,212 | 5/1976 | Bollis | 223/46 X |
| 3,988,102 | 10/1976 | Bakermans | 425/394 |
| 4,476,168 | 10/1984 | Aoyama | 428/4 |

*Primary Examiner*—Henry F. Epstein
*Attorney, Agent, or Firm*—Lyon & Lyon

[57] ABSTRACT

A bow form which may be constructed from a machine onto a spool of a plurality of bow forms which may be converted to a full bow by an ultimate user by pulling a drawstring is disclosed. The bow form may be constructed from a high grade ribbon fabric such as woven acetate. The bow form is constructed from two ribbons, a drawstring which may be made of an elastic material and a plurality of bands which may be formed from strips of material which are fused into bands during production of the bow form. When desired, the ultimate bow may be supported by a bow support which serves to provide additional support to the pile of loops of ribbon material to thereby prolong a fuller look in the bow.

31 Claims, 9 Drawing Figures

DECORATIVE PULL-STRING BOWS

BACKGROUND OF THE INVENTION

The field of the present invention relates generally to decorative bow forms, spools containing a plurality of such bow forms and decorative pull-string bows.

A decorative bow may normally be manufactured by hand or machine. However, when a bow will not be used soon after it is formed, or when there is not enough time or talent to hand tie a bow, it has been found convenient to prepare a bow form in which the loops of the bow have not yet been formed. In this state, which is less likely to be damaged, the bow form is easier to handle and store. Additionally, a bow form will not suffer the deterioration of its shape as might a fully formed bow which often droops or goes limp over prolonged periods of storage.

In general, a bow may be referred to as a "pull-string" type when it has two or more ribbons and at least one pull tape or drawstring which allows the assembly to be converted from essentially a flat bow form into a fully formed "floral", "pom-pom" or other types of bows. The flat bow form might be derived from a spool of bow forms from which a single bow form will need to be cut to produce a simple single bow form. The cut end of the single bow form may still need to be fastened together.

A pom-pom bow is generally distinguishable from a floral bow in that the loops which form a pom-pom bow tend to be of roughly the same length to create a relatively uniform or highly symmetrical pattern, whereas the loops which form a floral bow have a variety of lengths to create a relatively nonuniform shape which gives the appearance that the bow was tied by hand rather than by machine. The same considerations would also apply to a designer bow which should look hand tied; however, for the purpose of the present invention, the discussion hereinafter shall be limited to floral bows which shall by way of definition herein also include designer bows. In addition to the above-noted differences, pom-pom bows tend to be made of a plastic type of ribbon material which is more conducive to handling by a machine than the relatively delicate high grade ribbon materials commonly used in floral bows which are tied by hand. Thus, by way of example only, floral bows commonly made for the floral trade are tied by hand from relatively expensive woven acetate fabric which is stiffened by sizing. This more elegant material is easier to damage although it imparts a much more aesthetically pleasing appearance than a conventional plastic type of ribbon material used in most pom-pom bows formed by a machine. However, the increased expense arising from the material and labor are routinely absorbed in the floral trade in which the aesthetic appearance of the bow must compliment the aesthetic appearance of the floral arrangement.

Thus, there exists a need for a prefabricated bow form which can be constructed by a machine from high grade materials which will be aesthetically appealing after the bow form is converted to a bow for use in all types of applications. Such a bow form must be capable of being produced and stored without damage to delicate high grade ribbon materials. In addition, the bow form should provide a bow which will not break down or go limp within a short time after it is assembled into its full shape. Further, such a bow form should be capable of being stored and handled in a convenient dispenser or package which can contain a plurality of the prefabricated bow forms.

SUMMARY OF THE INVENTION

The present invention relates generally to prefabricated bow forms which can be constructed from high grade delicate ribbon materials. In another aspect of the present invention, floral bows having a hand-tied appearance can be constructed from a prefabricated bow form. In a further aspect of the present invention, prefabricated bow forms can be dispensed in an easy to use state from a protective storage spool containing a plurality of the bow forms.

When a prefabricated bow form is made in accordance with the present invention, a first plurality of bridging areas is formed by multiple cuts in a first ribbon while a second plurality of bridging areas is formed by multiple cuts in a second ribbon. The cuts and bridging areas of the ribbons may be formed by a machine at the same time so as to superimpose the plurality of bridging areas of the first ribbon upon the plurality of bridging areas of the second ribbon. The cuts are formed in such a way as to form a fused beaded area around the cut to prevent fraying and provide additional support to the bow. A drawstring, which may be elastic, is then connected between the first and second ribbons and a plurality of bands are formed around the first and the second plurality of bridging areas as well as the drawstring which is maintained between the first and second plurality of bridging areas. The plurality of bands may be formed from strips of material which are fused into bands having an effective width so as to function as a stacking, flexible or spring-like column when the bow is ultimately formed. The drawstring may be pulled through a bow support which may be retained with the ribbon in the full bow to provide additional support to the loops of ribbon material.

When a floral bow form is formed according to the present invention, the loops in the assembled floral bow will be of varying lengths and some of the cuts in the ribbons which form the bridging areas may be offset so as to impart a hand-tied appearance in the fully assembled bow.

A bow form constructed according to the present invention may be made of a delicate high grade ribbon material such as is presently used in floral bows which are hand tied. Further, such bow forms may be conveniently stored in a spool without damaging the ribbon material. When the bow forms are removed and assembled, the amount of labor needed to construct bows which previously had to be hand tied is greatly reduced. In addition, the amount of ribbon material used to form a bow will be minimized and waste resulting from human error involved in hand tying bows will be eliminated.

Accordingly, it is a primary object of the present invention to provide improved decorative bow forms, spools for storing and dispensing multiple bow forms and improved bows constructed from prefabricated bow forms.

These and further objects and advantages will be apparent to those skilled in the art in connection with the drawings and the detailed description of the preferred embodiment set forth below.

DETAILED DESCRIPTION OF THE PREFERRED EMBODIMENTS

Figures 1, 2, 3, 4, 5:
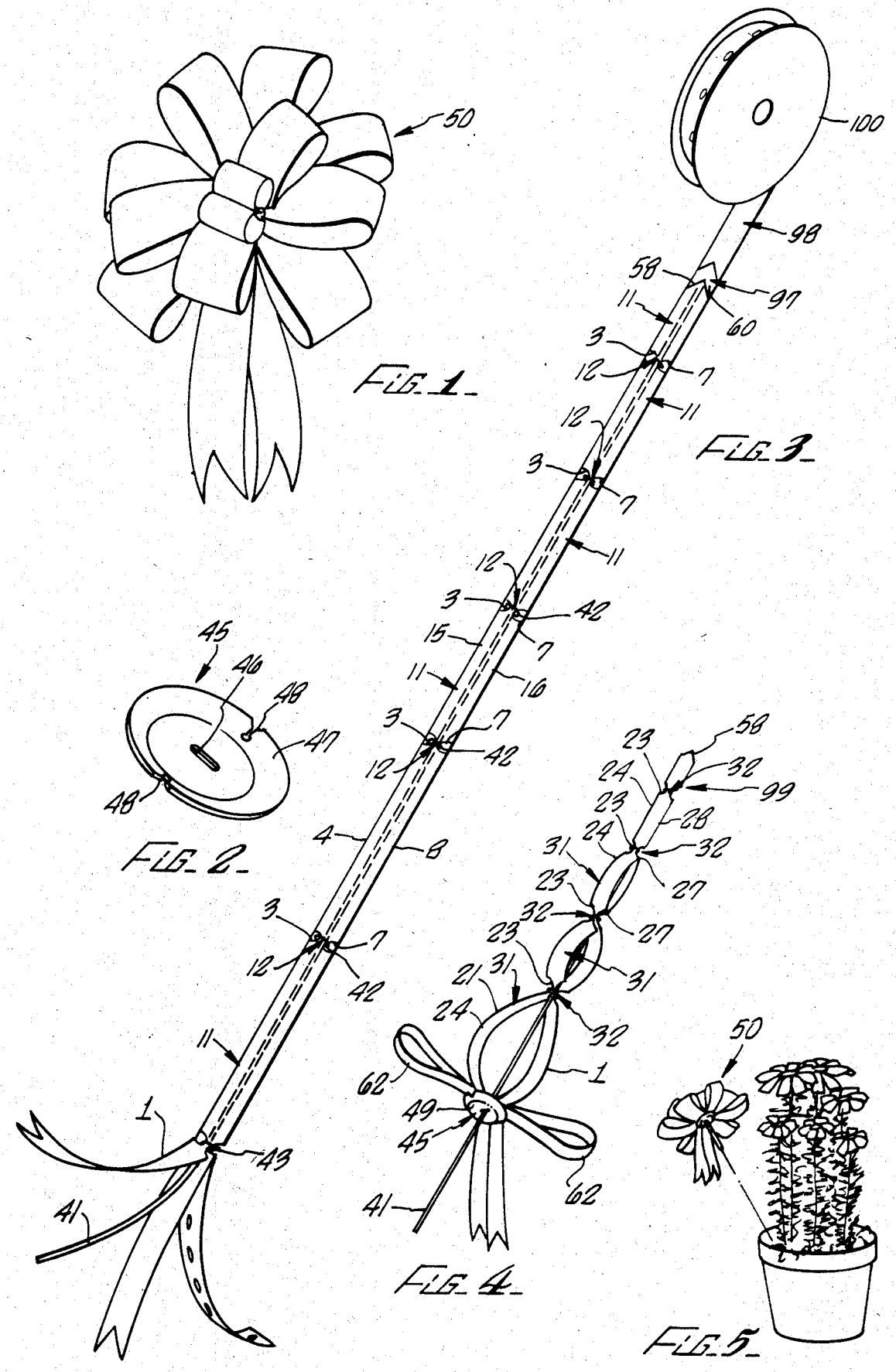
FIG. 1 is a plan view of a floral bow constructed from a floral bow form according to the present invention.
FIG. 2 is a perspective view of a bow support according to the present invention.
FIG. 3 is a perspective view of a spool of decorative bow forms according to the present invention which is partially unwound.
FIG. 4 is a perspective view of a decorative bow form according to the present invention which is in a partial stage of assembly.
FIG. 5 is a perspective view of a floral bow according to the present invention which is fully assembled and is being utilized in connection with a pot of flowers.

A preferred embodiment of a spool containing bow forms according to the present invention is depicted in FIG. 3. Two bow forms on a spool 100 are generally designated as 99 and 98, the latter bow form being shown in part only. The bow form 99 comprises a first ribbon 1, a second ribbon 21, a drawstring 41 and a plurality of bands 42. When the bow form 99 is fully assembled, a bow support 45, shown in FIG. 2, may be used to provide a surface against which the first and the second ribbons are forced so as to form a plurality of loops against the bow support. Thus, as shown in FIG. 4, as the drawstring 41 is pulled through drawstring opening 46 in bow support 45, the first ribbon 1 and the second ribbon 21 are forced against the bow support 45 and a stacking band 43 so as to begin the formation of a plurality of loops 62. The stacking band 43 is one of the plurality of bands 42 which is most proximate to the bow support 45 when the plurality of loops 61 begin to form. However, each of the plurality of bands 42 functions as a stacking band when a fully assembled bow, depicted in FIGS. 1 and 5 and generally designated as 50, is formed.

Figure 7:
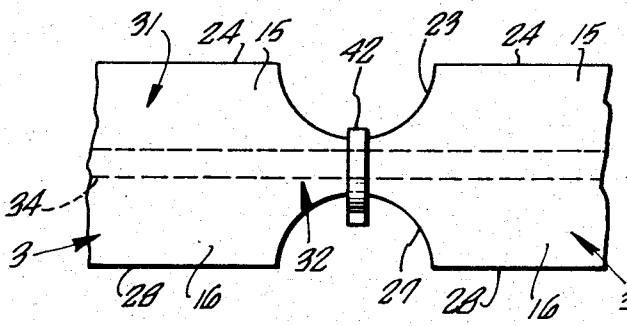
FIGS. 6, 7 and 8 are plan views of a partial cutaway of a ribbon used in a bow form according to the present invention.
Figure 6:
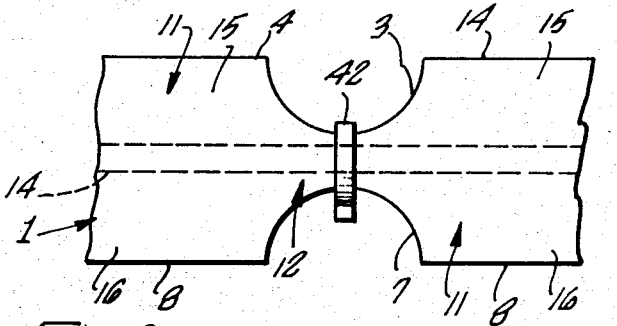

The first ribbon 1 and the second ribbon 21 have a number of areas formed in the ribbons, as is shown more fully in FIGS. 6 and 7. Thus, as shown in FIG. 3, the first ribbon 1 has a first plurality of cuts 3, one of which is shown in FIG. 6, in a first edge 4, and a second plurality of cuts 7, one of which is shown in FIG. 6, in a second edge 8. As shown in FIG. 3, the first plurality of cuts 3 and the second plurality of cuts 7 form a first plurality of uncut areas, generally designated as 11, between a first plurality of bridging areas, generally designated as 12. In addition, the first plurality of uncut areas 11 may be divided in half along the longitudinal axis 14, shown in FIG. 6, of the first ribbon 1 so as to form a first edge half 15 and a second edge half 16. Examples of a first edge half 15 and a second edge half 16 so formed are shown partially in FIG. 6. In a similar manner, the second ribbon 21 may be divided into a number of different areas. Thus, as shown in FIG. 4, the second ribbon 21 has a third plurality of cuts 23, one of which is shown in FIG. 7, in a third edge 24, and a fourth plurality of cuts 27, one of which is shown in FIG. 7, in a fourth edge 28. As shown in FIG. 4, the third plurality of cuts 23 and the fourth plurality of cuts 27 form a second plurality of uncut areas generally designated as 31, between a second plurality of bridging areas, generally designated as 32. In addition, the second plurality of uncut areas 31 may be divided in half along the longitudinal axis 34, shown in FIG. 7, of the second ribbon 21 so as to form a first edge half 15 and a second edge half 16. Examples of a first edge half 15 and a second edge half 16 so formed are shown partially in FIG. 7.

Figure 8:
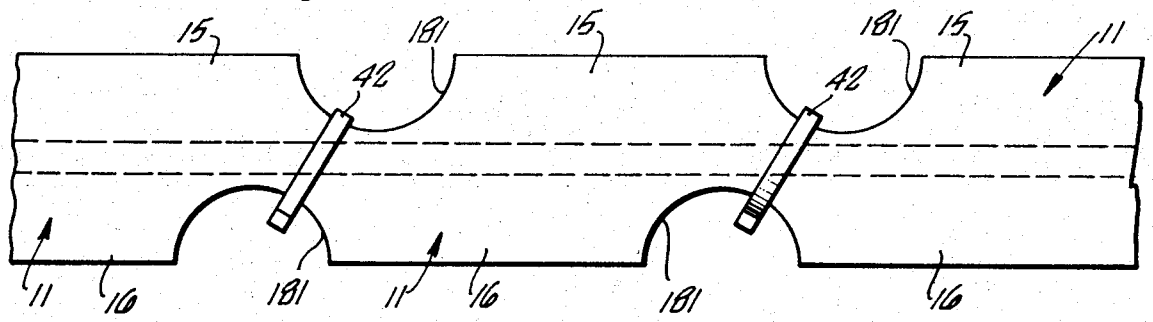

As shown in FIG. 8, the first plurality of uncut areas 11 may be divided into a first edge half 15 and a second edge half 16 in which the first edge half 15 is longer than the second edge half 16. This in turn will cause the loop formed from the unequal first and second edge halves 15 and 16 in the plurality of loops 62 to be formed at a predetermined angle. Thus, by varying the lengths of the first edge half 15 relative to its corresponding second edge half 16 in one or more of the uncut areas in first plurality of uncut areas 11, the appearance or design form of a bow may be changed. Of course, the first edge 15 and the second edge 16 of the second plurality of uncut areas 31 would also be changed correspondingly. Accordingly, the design or arrangement of a bow may take on any one of a number of forms. Further, when the first edge half 15 and the second edge half 16 are unequal in length, the resultant shape of the uncut area will be relatively fixed in the assembled bow. Thus, special intricate patterns can be reproduced with a high degree of repeatability to a particular design form which may still be altered by hand, if desired, to adjust the bow to a particular need when at least a few of the corresponding first and second edge halves are of equal length. This should be contrasted to a bow in which all of the first edge halves 15 and the second edge halves 16 are of substantially equal length to produce a relatively simple pattern which may be adjusted by hand to alter the pile of loops and the resultant appearance of the bow.

Figure 9:
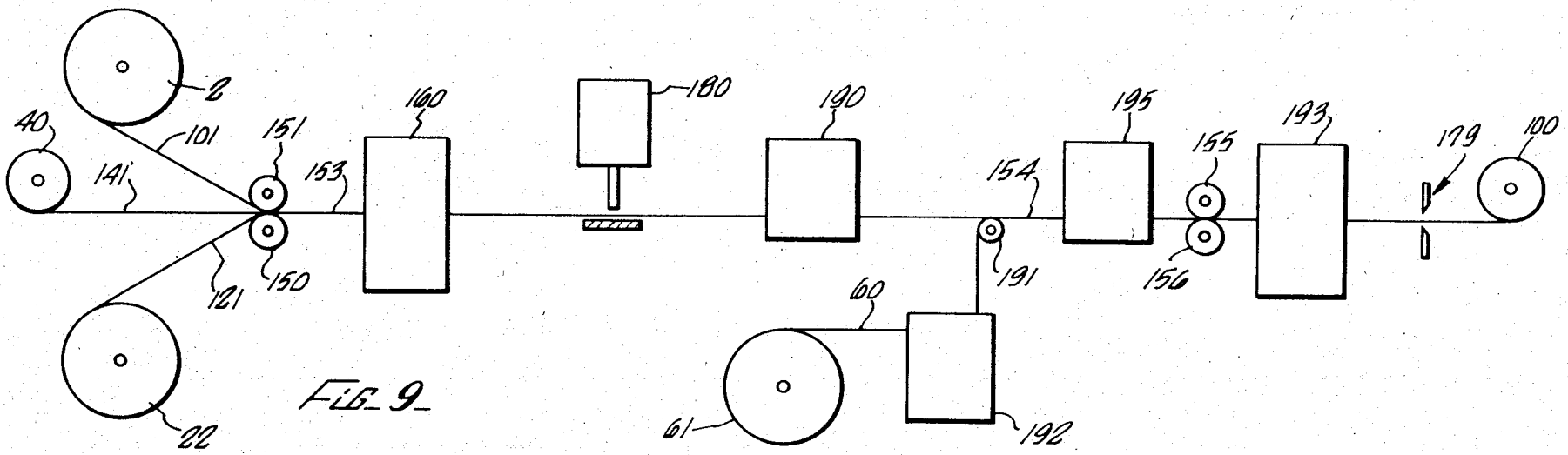
FIG. 9 is a diagrammatic view of a machine constructing a spool of bow forms according to the present invention.

A machine for producing a spool of bow forms according to the present invention is shown diagrammatically in FIG. 9. A spool 22 continuously feeds a ribbon 121 through the machine. At the same time, a spool 40 continuously feeds a strip of drawstring material 141 on top of the ribbon material 121 while a spool 2 continuously feeds a strip of ribbon material 101 on top of the drawstring material 141. The ribbon material 121, the drawstring material 141 and the ribbon material 101 converge at pinch rollers 150 and 151 to form a composite strip 153 which is fed into a vacuum buffer chamber 160. After the composite strip 153 leaves the vacuum buffer chamber 160, it passes to a cutting station 180 which cuts the ribbon materials 101 and 121 by the use of a heated blade at approximately 700° F.

In order to cut the ribbon materials 101 and 121, the movement of the composite strip is temporarily stopped within the cutting station. However, since the ribbon materials 101 and 121 are continuously fed into the machine, the vacuum buffer chamber 160 is provided to compensate for the quickly varying tension which will develop in the ribbon materials 101 and 121 between the reels 22 and 40 and the cutting station 180. Inside the vacuum buffer chamber 160, a partial vacuum will cause the composite strip 153 to form a loop when the composite strip 153 is stopped at the cutting station 180. As the composite strip 153 begins to move again through the cutting station 180, the loop will decrease. This action will repeat as the material is intermittently indexed. In the absence of a buffer means such as the vacuum buffer chamber 160, the quickly varying tension on the composite strip 153 could cause damage to the first and second ribbons of the composite strip 153, especially to relatively delicate materials such as woven acetate. Additionally, without a means to regulate the quickly varying tension, the composite strip 153 could become tangled or fouled within the machine with a resultant loss of materials and an increased production downtime.

In the cutting station 180, the heated blade is purposely made with a circular cross section which pinches and fuses the ribbon materials 101 and 121. This fusion produces the fused beads of ribbon material which are generally depicted as 181 in FIG. 8. Although the fused beads are only shown in FIG. 8, it should be recognized that fused beads will be formed in every cut made in the ribbon materials 101 and 121 at the cutting station 180. This fusion, which is especially important when the ribbon materials 101 and 121 are formed of a high grade delicate material, such as woven acetate, serves several functions. First, because the blade is dull instead of sharp, it does not have to be sharpened after prolonged use to maintain a fine cutting edge which would puncture the ribbon materials 101 and 121 to form a cut instead of pinching and fusing the ribbon materials 101 and 121 to form a cut. Additionally, because the blade material thickness is uniform from top to bottom, any wear which does take place in the blade does not affect the uniformity of the cutting surface of the blade. In contrast, if the blade was simply sharp and heated, mechanical wear would still take place, possibly at a somewhat slower rate; however, at such an elevated temperature, most materials would oxidize at the thin cross-sectional dull area of a sharpened blade. The second function of the dull blade is that the fusion tends to seal the fibers of a fine fabric to prevent them from further unraveling throughout the processing and life of the ribbon and bow. Finally, a third function of the dull blade is that the micro edge of the fused bead area tends to stiffen the ribbon material in the narrow width area of the cuts, which are shown in FIGS. 6 through 8 as having a scallop shape, thus tending to form a fluffier bow with more resistance to breakdown. Thus, the fused bead areas tend to act like two ribs which provide further support for the bow. It has been found that the blade may be advantageously heated to a temperature of about 700° F. when the ribbon materials 101 and 121 are made of woven acetate. However, an unheated sharp blade works best for certain materials such as a flocked woven acetate. Accordingly, the temperature of the blade may be changed as required by the characteristics of the materials used in the ribbon materials 101 and 121.

After the composite material 153 leaves the cutting station 180, it enters the band formation station 190 which is designed for high speed production with a continuous feed of raw banding material. The banding station 190 forms the plurality of bands 142 around the composite material 153 between the cuts formed in cutting station 180. The banding material can be heat-sealed or ultrasonically welded at a very high speed to fuse the banding material into a continuous retainer with no ends around the ribbon material. The banding material should preferably be made of a nonmetallic material so as not to rust and/or discolor delicate ribbon materials. It should preferably be soft and pliable so as not to abrade or puncture the ribbon materials during fabrication of the bow form or during the life of the full bow which may be handled incorrectly. Additionally, the material should not scratch or puncture other objects to which the bow may ultimately be mounted. A very important aspect of the banding material is that it must be pliable and have a low coefficient of friction to both the ribbon material and the drawstring material contained within so as to allow an easy pull on the drawstring to form a floral type bow. Such pulling action allows for a smooth rotating action required in order to form a bow with properly dispersed loops. It is also preferable that the plurality of bands 142 be formed from an elastic material.

Once a proper banding material is chosen, the width of each of the plurality of bands 42 normal to the direction of the longitudinal axes 14 and 34 should be such that the plurality of bands 42 function as a stacking column to leave a small space in between each of the loops in the plurality of loops when the drawstring 41 is drawn through the drawstring opening 46 of the bow support 45. Thus, it has been found that an effective width of the plurality of bands 42 depends on the diameter of the plurality of bands in relation to the width of the band material in relationship to the width of the plurality of bridging areas encircled. By way of example, when the plurality of bands 42 have a diameter between about 0.3 and 0.4 inches, the bridging area has a width parallel to the areas 14 and 34 of between about 0.3 to about 0.4 inches, the first ribbon 1 and the second ribbon 21 each have a width between about one inch to about one and one half inches, then the effective width of the plurality of bands 42 is between about 0.06 to about 0.09 of an inch. The stacking column which results from a plurality of bands 42 with a proper effective width gives the fully constructed bow 50 more of a full dimensional effect as well as the appearance of hand tying. Further, when the plurality of bands 42 are of an effective width so as to provide a stacking column, the loops of the fully formed bow 50 are prevented from being pulled too tightly together. If the loops were allowed to be pulled too tightly together, the plurality of bridge areas 41 could overstress and become limp from the center causing the loops to relax and lay down. This very same principle will allow the pompom bows to be formed from less material than conventional pompom bows because not as many loops are required to support each other in order to maintain a full appearance.

After the band formation station 190, the composite material 153 is passed to a roller 191 at which a backing material 60 is continuously fed beneath the composite material 153 to form a second composite 154. The backing material 60 is fed from a spool 61 through a second vacuum buffer chamber 192 to the roller 191. The second vacuum buffer chamber 192 functions in a manner similar to vacuum buffer chamber 160 to control quickly varying tension resulting from continuous intermittant motion. The second composite 154 is passed to a bow cutting station 195 which cuts the ribbon materials 101 and 121 as well as the drawstring material 141 without cutting through the backing material 60. After this cutting step, the first ribbon 101 and the second ribbon 121 are bonded together with the drawstring 141 at an inner end 58, shown in FIG. 3, which may be connected to the backing material 60. Although the foregoing has been described as requiring several processing steps, it is possible to combine one or more of these steps in a single action. Thus, by way of example only, the inner end 58 may be fused to the backing material 60 at the same time that the inner end 58 is being formed.

In a preferred embodiment of a bow according to the present invention, a clear low cost material for the drawstring is chosen which, depending on the type of ribbon material used, will allow a bond compatible fuse to be made between the ribbon material and the drawstring materials to thus eliminate the need for a separate adhesive application. Thus, by way of example, a urethane or a pre-oriented nylon clear copolymer can be used to ultrasonically or thermally bond directly to woven acetate ribbon material so as to require no separate adhesives whatsoever. When a fusion step as thus described is utilized, the production speed of the bows can be increased. Further, an ultrasonic or thermal bond provides for a clean, strong terminating end to the bow which is more aesthetically pleasing. When a clear or translucent drawstring material is utilized, the drawstring material will appear to take on the colors of the ribbon material and the medium in which it is attached. This in turn will facilitate automation of the manufacture of bow forms or spools of bow forms according to the present invention in that the color of the drawstring 41 will not have to be matched with the color or colors of the first ribbon 1 and the second ribbon 21.

In order to provide improved support for a bow 50 according to the present invention, the drawstring 41 is preferably made of an elastic material. Alternatively, the drawstring 41 may be made of non-elastic material if the plurality of bands 42 are made of an elastic material and a bow support 45 is used. Additional support in the latter case would be achieved if the drawstring 41 was also made of an elastic material. Such support is important for the bow 50 to have a full appearance which will last for more than a short period of time and to provide the person forming the bow with a wider latitude of tension when locking or tying the drawstring. This is especially important when the ribbon material is a relatively delicate material as is typically used in floral bows.

After the second composite 154 leaves bow cutting station 195 it will enter a second pair of pinch rollers 155 and 156 before entering a third vacuum buffer chamber 193 which also works in a similar manner as vacuum buffer chamber 160 to control varying tension resulting from intermittent to continuous motion. The backing support material 60 will continue to be wound around spool 100 until the spool 100 is fully wound with the desired number of bow forms. Once the spool 100 has been filled, the backing support material 60 is cut in cutting station 179 and a new spool can be moved into place so as to continue production.

When a spool of decorative bow forms 100 is constructed according to the present invention, the spool may be conveniently handled and stored without damage to the bow forms. Such handling and storage may be further facilitated by using a backing support material 60 which is compressible, an example of which is corrugated paper. The compressibility of the backing support material 60 will serve to insulate the delicate ribbon materials and provide a further buffer against possible indentations or embossing which could be caused by the plurality of bands 42. In addition, the backing support material 60 allows delicate ribbon materials to be wound in a spool. Thus, for example, if a ribbon form constructed of a woven acetate material were wound upon one another.

When the plurality of bow forms are wound around spool 100 in a machine in accordance with the present invention, a space, an example of which is generally designated as 97 in FIG. 3, between the end of an earlier wound bow, form 98 for example, and the inner end 58 of the bow being wound, 99 for example, is maintained such that the bow forms will not be in contact with each other. This space is crucial since a progressive stress would ultimately build up at the band tie point 12 when an inner layer is wound under the outer layer of a bow because of the way two layers shift with respect to one another as they are rolled up. However, now that each bow form is cut free from the next bow form, with each bow form being connected to the backing support material 60 at a connection point, a spool of bow forms can be constructed continuously.

After production of a spool of bow forms, the spool may be compactly and conveniently stored. As each bow form is removed from the spool of bow forms, the backing support material 60 can be severed at the open space 97 occurring between the bow form which is to be used and the next bow form on the spool. The backing support material 60 may be provided with a plurality of holes 260, shown in FIG. 3, so that the user may view the color and material of the bow on the spool 100 through one of the plurality of holes 260. In a preferred embodient of the present invention, it has been found advantageous to provide the user with bow supports 45 with drawstring opening 46 through which the drawstring 41 may be pulled. The curved shaped portion 47 of the bow support 45, which may be shaped in the form of a cup, will also serve to force the first ribbon 1 and the second ribbon 21 which are pulled against the bow support 45 into a pile of loops 62. When the inner end 58 has been pulled into the pile of loops 62, the drawstring 41 may then be retained in locking slots 48 on the back surface of the bow support 45 to complete the formation of the bow 50. The excess drawstring material may be cut or may be used to tie the bow around an object to which it is desired to affix the bow. As shown in FIG. 2, locking slots 48 are provided in the bow support 45 to facilitate locking of the drawstring 41. Thus, by way of example only, a bow 50 has been shown as being affixed to a stick in FIG. 5. Alternatively, the excess drawstring material 41 may simply be cut. Further, the bow support 45 could be formed integral with an object, such as a stick, to which a bow 50 can be attached.

Although one of the preferred embodiments of the present invention is described as having a bow support 45 which has a cup-shaped curved area 47 which is ultimately affixed to the pile of loops so as to provide support for the bow, especially for floral bows of delicate ribbon material, the bow support 45 may take on a variety of forms. Thus, by example only, the bow support 45 could be a planer form with a drawstring opening 46 and an adhesive back surface which can be used to mount the bow to a desired surface.

Having fully described the present invention, it will be apparent from the above description and drawings that various modifications may be made within the scope of the present invention. Therefore, the invention is not intended to be limited to the particular embodiments and procedures set forth above except as may be required by the lawful scope of the following claims.

What is claimed is:

1. A decorative bow, comprising:

an elastic drawstring;

a first ribbon having a first plurality of cuts in a first edge and a second plurality of cuts in a second edge, said first ribbon having a first plurality of bridging areas formed between the first plurality of cuts and the second plurality of cuts and a first plurality of uncut areas formed between the first plurality of bridging areas;

a second ribbon having a third plurality of cuts in a third edge and a fourth plurality of cuts in a fourth edge, said second ribbon having a second plurality of bridging areas formed between the third plurality of cuts and the fourth plurality of cuts and a second plurality of uncut areas formed between the second plurality of bridging means, said second ribbon being connected to the drawstring and the first ribbon, the drawstring being connected between the first ribbon and the second ribbon;

a plurality of bands encircling the first plurality of bridging areas, the second plurality of bridging areas and the drawstring, said drawstring being held between the first plurality and the second plurality of bridging areas; and a bow support having a drawstring opening through which the drawstring is pulled to force the first and the second ribbons into a plurality of loops against the bow support.

2. A bow as recited in claim 1 wherein each uncut area of the first and the second plurality of uncut areas has a first edge half and a second edge half, the first edge half being longer than the second edge half in at least one of the first plurality of uncut areas and in at least one of the second plurality of uncut areas.

3. A bow as recited in claim 1 wherein the plurality of bands are formed from a banding material which is pliable and will not abrade the first and the second ribbons.

4. A bow as recited in claim 1 wherein the plurality of bands have an effective width such that said plurality of bands function as a stacking column to leave a space in between each of the loops in the plurality of loops when the drawstring is pulled through the drawstring opening.

5. A bow as recited in claim 1 wherein the first and the second ribbons have a width of between about one inch to about one and one half inches and the plurality of bands have a width between about 0.06 to about 0.09 of an inch.

6. A bow as recited in claim 1 wherein the first and the second ribbons are made of a woven fabric.

7. A bow as recited in claim 6 wherein the first, second, third and fourth plurality of cuts are formed so as to produce a fused bead of ribbon material around each of the cuts.

8. A bow as recited in claim 1 wherein the drawstring is fused between the first and the second ribbons.

9. A bow as recited in claim 8 wherein the first and the second ribbons are made of acetate.

10. A bow as recited in claim 9 wherein the drawstring is made of an urethane material.

11. A bow as recited in claim 1 wherein the plurality of bands are made of an elastic material.

12. A bow as recited in claim 1 wherein the plurality of bands are formed from a plurality of strips which are fused to connect the ends of the plurality of strips together.

13. A bow as recited in claim 1 wherein the first and the second plurality of uncut areas contain at least two areas of different lengths.

14. A bow as recited in claim 1 wherein the bow support has a cup-shaped surface against which the first and the second ribbons are forced when the drawstring is pulled through the drawstring opening, the cup-shaped surface providing support for the pile of loops.

15. A floral bow, comprising:

an elastic drawstring;

a first ribbon made of a woven fabric having a first plurality of cuts in a first edge and a second plurality of cuts in a second edge, said first ribbon having a first plurality of bridging areas formed between the first plurality of cuts and the second plurality of cuts and a first plurality of uncut areas having a first edge half and a second edge half formed between the first plurality of bridging areas, the first edge half of at least one of the first plurality of uncut areas being longer than the second edge half of said one of the first plurality of uncut areas;

a second ribbon made of a woven fabric having a third plurality of cuts in a third edge and a fourth plurality of cuts in a fourth edge, said second ribbon having a second plurality of bridging areas formed between the third plurality of cuts and the fourth plurality of cuts and a second plurality of uncut areas having a third edge half and a fourth edge half formed between the second plurality of bridging areas, the third edge half of at least one of the second plurality of uncut areas being longer than the fourth edge half of said one of the second plurality of uncut areas, said second ribbon being connected to the drawstring and the first ribbon, the drawstring being connected between the first ribbon and the second ribbon;

a plurality of bands formed from a banding material which is pliable and will not abrade the first and the second ribbons, the plurality of bands having an effective width such that said plurality of bands function as a stacking column, the plurality of bands encircling the first plurality of bridging areas, the second plurality of bridging areas and the drawstring, said drawstring being held between the first plurality and the second plurality of bridging areas; and a bow support having a drawstring opening through which the drawstring is pulled to force the first and the second ribbons into a plurality of loops against the bow support, said plurality of loops having a plurality of spaces in between each of the loops, said plurality of loops being formed from the first and the second plurality of uncut areas, each of which contain at least two uncut areas of different lengths.

16. A bow as recited in claim 15 wherein the first and the second ribbons have a width of between about one inch to about one and one half inches and the plurality of bands have a width between about 0.06 to about 0.09 of an inch.

17. A bow as recited in claim 15 wherein the first, second, third and fourth plurality of cuts are formed so as to produce a fused bead of ribbon material around each of the cuts.

18. A bow as recited in claim 15 wherein the drawstring is fused between the first and the second ribbons.

19. A bow as recited in claim 18 wherein the first and the second ribbons are made of acetate and the drawstring is made of an urethane material.

20. A bow as recited in claim 15 wherein the bow support has a cup-shaped surface against which the first and the second ribbons are forced when the drawstring is pulled through the drawstring opening, the cup-shaped surface providing support for the pile of loops.

21. A decorative bow, comprising:

an elastic drawstring;

a first ribbon having a first plurality of cuts in a first edge and a second plurality of cuts in a second edge, said first ribbon having a first plurality of bridging areas formed between the first plurality of cuts and the second plurality of cuts and a first plurality of uncut areas formed between the first plurality of bridging areas;

a second ribbon having a third plurality of cuts in a third edge and a fourth plurality of cuts in a fourth edge, said second ribbon having a second plurality of bridging areas formed between the third plurality of cuts and the fourth plurality of cuts and a second plurality of uncut areas formed between the second plurality of bridging means, said second ribbon being connected to the drawstring and the first ribbon, the drawstring being connected between the first ribbon and the second ribbon; and a plurality of bands encircling the first plurality of bridging areas, the second plurality of bridging areas and the drawstring, said drawstring being held between the first plurality and the second plurality of bridging areas, the plurality of bands being formed from a banding material which is pliable and will not abrade the first and the second ribbons, said plurality of bands having an effective width such that said plurality of bands function as a stacking column to leave a space in between each loop in a plurality of loops formed from the first and second plurality of uncut areas.

22. A bow as recited in claim 21 wherein each uncut area of the first and second plurality of uncut areas has a first edge half and a second edge half, the first edge half being longer than the second edge half in at least one of the first plurality of uncut areas and in at least one of the second plurality of uncut areas.

23. A bow as recited in claim 21 wherein the first and the second ribbons have a width of between about one inch to about one and one half inches and the plurality of bands have a width between about 0.06 to about 0.09 of an inch.

24. A bow as recited in claim 21 wherein the first and the second ribbons are made of a woven fabric.

25. A bow as recited in claim 24 wherein the first, second, third and fourth plurality of cuts are formed so as to produce a fused bead of ribbon material around each of the cuts.

26. A spool of decorative bows, comprising:

a reel;

a separation strip wound around the reel; and a drawstring; a first ribbon having a first plurality of cuts in a first edge and a second plurality of cuts in a second edge, said first ribbon having a first plurality of bridging areas formed between the first plurality of cuts and the second plurality of cuts and a first plurality of uncut areas formed between the first plurality of bridging areas; a second ribbon having a third plurality of cuts in a third edge and a fourth plurality of cuts in a fourth edge, said second ribbon having a second plurality of bridging areas formed between the third plurality of cuts and the fourth plurality of cuts and a second plurality of uncut areas formed between the second plurality of bridging means, said second ribbon being connected to the drawstring and the first ribbon, the drawstring being connected between the first ribbon and the second ribbon at an inner end; and a plurality of bands encircling the first plurality of bridging areas, the second plurality of bridging areas and the drawstring, said drawstring being held between the first plurality and the second plurality of bridging areas such that the first and second plurality of uncut areas will form a plurality of loops when the drawstring is pulled through a stacking band and the inner end is pulled toward the stacking band, each of the plurality of bows being connected to the separation strip located such that the first and second ribbons of each of the plurality of bows are spaced apart from the first and second ribbons of all the other bows in the plurality of bows.

27. A spool as recited in claim 26 wherein the separation strip is constructed of a compressible material which protects the first and second ribbons from deformation.

28. A spool as recited in claim 26 wherein each of the plurality of bows is connected at its inner end to the separation strip.

29. A bow as in claim 6 wherein the decorative bow is a floral bow.

30. A bow as in claim 24 wherein the decorative bow is a floral bow.

31. A bow as in claim 21 wherein the plurality of bands are formed from a plurality of strips which are fused to connect the ends of the plurality of strips together.

* * * * *